US010005313B2

(12) United States Patent
Heimlich

(10) Patent No.: US 10,005,313 B2
(45) Date of Patent: Jun. 26, 2018

(54) DECORATIVE SURROUND

(71) Applicant: Plantum, Inc., Los Angeles, CA (US)

(72) Inventor: Micah Heimlich, Los Angeles, CA (US)

(73) Assignee: Plantum, Inc., Los Angeles, CA (US)

( * ) Notice: Subject to any disclaimer, the term of this patent is extended or adjusted under 35 U.S.C. 154(b) by 0 days. days.

(21) Appl. No.: 14/695,645

(22) Filed: Apr. 24, 2015

(65) Prior Publication Data

US 2015/0306902 A1 Oct. 29, 2015

Related U.S. Application Data

(60) Provisional application No. 61/983,893, filed on Apr. 24, 2014.

(51) Int. Cl.

| | |
|---|---|
| ***A47G 7/08*** | (2006.01) |
| ***B44C 1/10*** | (2006.01) |
| ***B44C 1/00*** | (2006.01) |
| ***B44C 1/18*** | (2006.01) |

(52) U.S. Cl.

CPC ..... *B44C 1/10* (2013.01); *A47G 7/08* (2013.01); *B44C 1/00* (2013.01); *B44C 1/18* (2013.01)

(58) Field of Classification Search

CPC ..... A47G 33/12; A47G 7/08; Y10T 16/5472; Y10T 428/169; Y10T 428/18

USPC ..... 428/99; 47/66.3, 66.4, 72, 41.02; 16/239; 63/9, 10; 368/282; 24/265 WS

See application file for complete search history.

(56) References Cited

U.S. PATENT DOCUMENTS

| | | | | |
|---|---|---|---|---|
| 1,393,591 | A | 10/1921 | Walter | |
| 2,110,981 | A * | 3/1938 | Auslander | A47G 7/08 47/72 |
| 3,628,216 | A * | 12/1971 | Savell | E05D 3/10 16/287 |
| 3,902,541 | A | 9/1975 | Wardwell | |
| 5,256,461 | A * | 10/1993 | Johnson | A47G 7/08 428/34.1 |
| 6,625,929 | B1 * | 9/2003 | Lawson | A01G 9/028 47/66.1 |
| 2007/0028518 | A1 | 2/2007 | Weder | |
| 2008/0276420 | A1 * | 11/2008 | Johnson | A47G 1/065 16/231 |
| 2012/0240465 | A1 * | 9/2012 | Weder | B65B 25/026 47/72 |

FOREIGN PATENT DOCUMENTS

| | | | |
|---|---|---|---|
| CH | 318155 | A | 12/1956 |
| FR | 2489126 | A1 | 3/1982 |
| WO | 2009045009 | A1 | 4/2009 |

OTHER PUBLICATIONS

Plant Huggy; planthuggy.com; Nov. 24, 2007; 3pp.

* cited by examiner

*Primary Examiner* — Joanna Pleszczynska

(74) *Attorney, Agent, or Firm* — Avyno Law P.C.

(57) ABSTRACT

A decorative surround is provided that wraps around a container, such as a plant container, to act as a decorative cover. The decorative surround is made of a modular construction to allow it to fit any shape or size of container. The decorative surround is comprised of a series of slats fastened together by a fastening mechanism that creates a hinged connection between the slats.

9 Claims, 18 Drawing Sheets

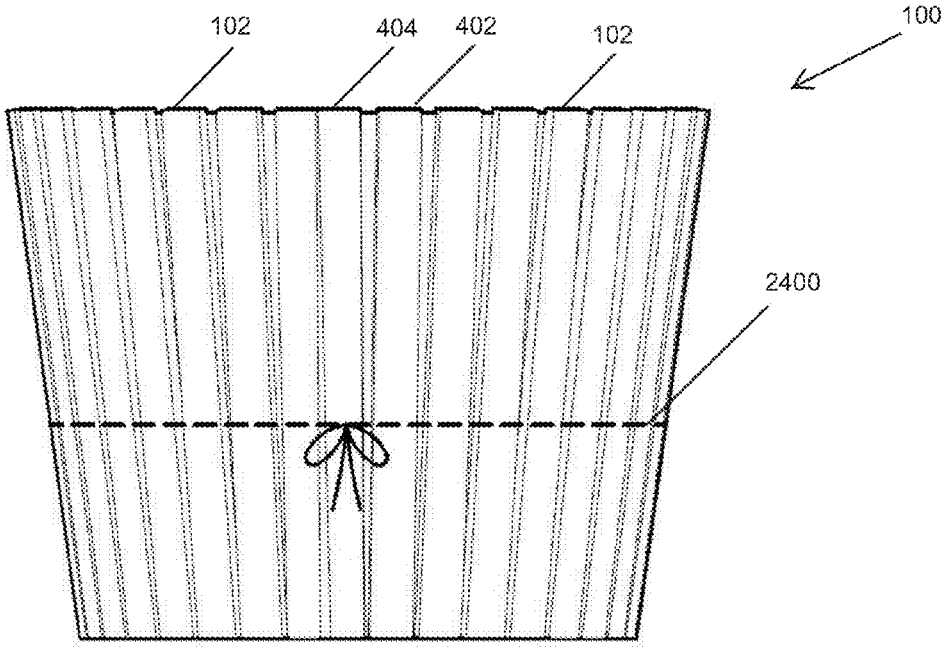
Figure 24a
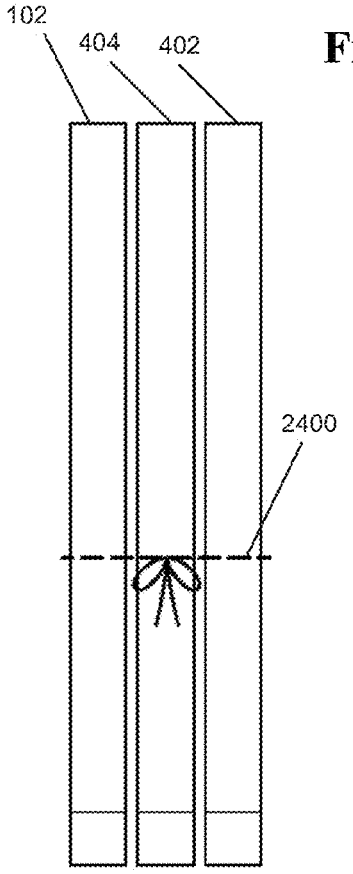
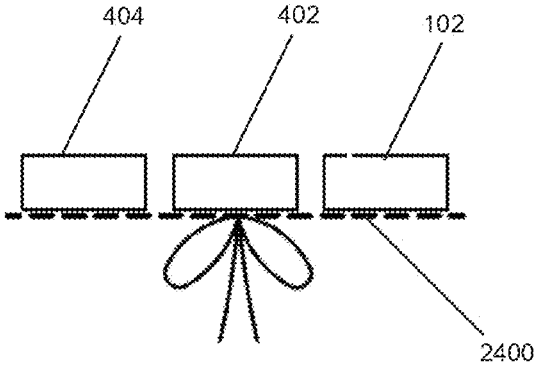
Figure 24b
Figure 24c

DECORATIVE SURROUND

RELATED APPLICATIONS

This application claims priority of U.S. Provisional Patent Application Ser. No. 61/983,893, filed on Apr. 24, 2015, titled PLANTER SURROUND, which application is incorporated in its entirety by reference in this application.

BACKGROUND

1. Field of the Invention

A decorative surround is provided that wraps around a container, such as a plant container, to act as a decorative cover. In particular, the described surround is modular and constructed in such a way that it will fit most any shape or size of container.

2. Related Art

Plants and planter pots are often a source of frustration for gardeners and landscape designers. The need for frequent repotting is often time-consuming, may be detrimental to the appearance and health of the plants, and risks lengthening plant recovery time. Further, repotting requires additional planting materials and labor. Repotting may also cause leaf or flower drop, root damage, and other undesirable problems. Solutions to minimize repotting of plants continue to be desired.

Further, after the plant has acclimatized to the new area, and/or has finished flowering, or the correct season for replanting has presented itself, the plant may need to be repotted in another, usually larger container. A need exists to help minimize the continued purchase of larger containers for replanting.

SUMMARY

The present invention provides one possible solution to avoid issues with replanting. The present invention provides a decorative surround that acts as an attractive covering for a plant while it remains in its original or current container. Further, the decorative surround can be modified to accommodate the plant container by expanding or contracting in size.

The decorative surround of the present invention wraps around a plant container to act as a decorative cover. The decorative surround is made of a modular construction to allow it to fit any shape or size of container. The decorative surround is composed of an array of slats fastened together by a series of fastening mechanisms that create hinged connections between the slats, which connections pivot in both the vertical and horizontal direction. The array is then secured around an object using a securing mechanism to maintain opposing ends of the array together in a fixed position around the object.

Due to the modular construction of the decorative surround of the present invention, the decorative surround can be resized to fit around different sized containers. For example, the decorative surround can be resized, by expansion, for example, by adding or subtracting slats or sections to the array of slats comprising the decorative surround. In this manner, the same decorative cover could still be used after the plant is repotted in a larger container.

Other devices, apparatus, systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE FIGURES

The invention may be better understood by referring to the following figures. The components in the figures are not necessarily to scale, emphasis instead being placed upon illustrating the principles of the invention. In the figures, like reference numerals designate corresponding parts throughout the different views.

FIG. 24*a* illustrates another example of a securing mechanism for securing the array of slats around an object.

FIG. 24*b* illustrates an elevation view of the securing mechanism as it would appear adjoining the first and second array ends.

FIG. 24*c* illustrates a plan view of FIG. 24*b*.

DETAILED DESCRIPTION

Figure 1:
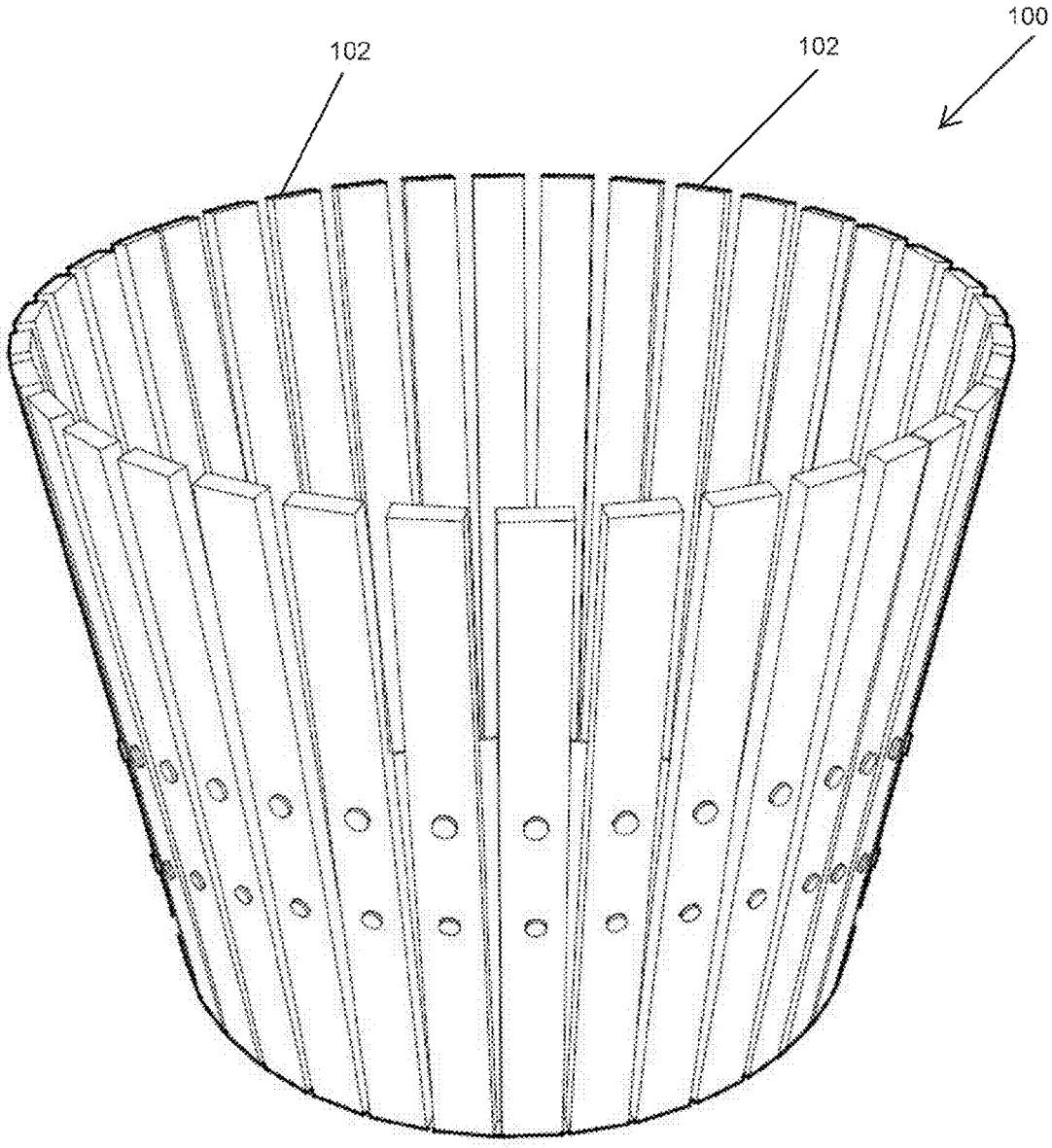
FIG. 1 is a top perspective view of one example of a decorative surround of the present invention.

As illustrated in the attached FIGS. 1-37, a decorative surround 100 is provided that wraps around and covers containers 400, such as plant containers. For purposes of this application, a "container" can be any pot, planter or other device capable of housing any solid, liquid or combination thereof, including, but not limited to, soil and/or a plant. The "decorative surround" shall mean a device capable of surrounding any container, of any size or shape, to create the appearance of a planter when installed around the container.

The decorative surround 100 of the present invention is constructed in a modular fashion so as to allow it to fit any shape or size of container. The decorative surround 100 is composed of a series of slats 102 fastened together by a system of magnets, hinges, buckles, pins, fasteners and/or any other fastening mechanism 104 that provides for a hinged or flexible connection between the slats 102. The fastening mechanisms 104 may be offset along the slats 102 (positioned just below center) to accommodate flaring suitable for tapered containers 400. In certain implementations, the decorative surround 100 could even be reversible.

The attached illustrated FIGS. 1-37 show several examples of a decorative surround 100 of the present invention. As illustrated in the attached figures, the decorative surround 100 is constructed from an array of slats 102. The slats 102 may be made of varying widths, lengths, heights and shapes so as to surround different sized containers 400. As will be explained further below, the slats 102 are connected such that the number of slats 102 in an array may be increased or decreased to wrap around different sized containers or objects. In this manner, the decorative surround 100 is expandable or modular.

The slats 102 may be made of any variety of materials, such as metal, aluminum, stone, precast concrete, wood, acrylic, ceramic, nylon, pressed fiber board, plastic, synthetic material or any composite of any of the foregoing, to name a few examples. The slats 102 may also come in a variety of colors and include any number of decorative elements added, placed on or designed in or on the slats 102.

As illustrated in connection with the FIGS. 34-37, the slats 102 may come in different shapes, cross-sections and include varying ornamental features so as to alter the overall look of the decorative surround 100. Further, while the invention is illustrated and described for purposes of surrounding a plant container, those skilled in the art will recognize that the decorative surround 100 of the present invention may be used to surround any number of objects or containers, including, but not limited to, trash bins, water coolers, or other containment systems and objects.

Figure 4:
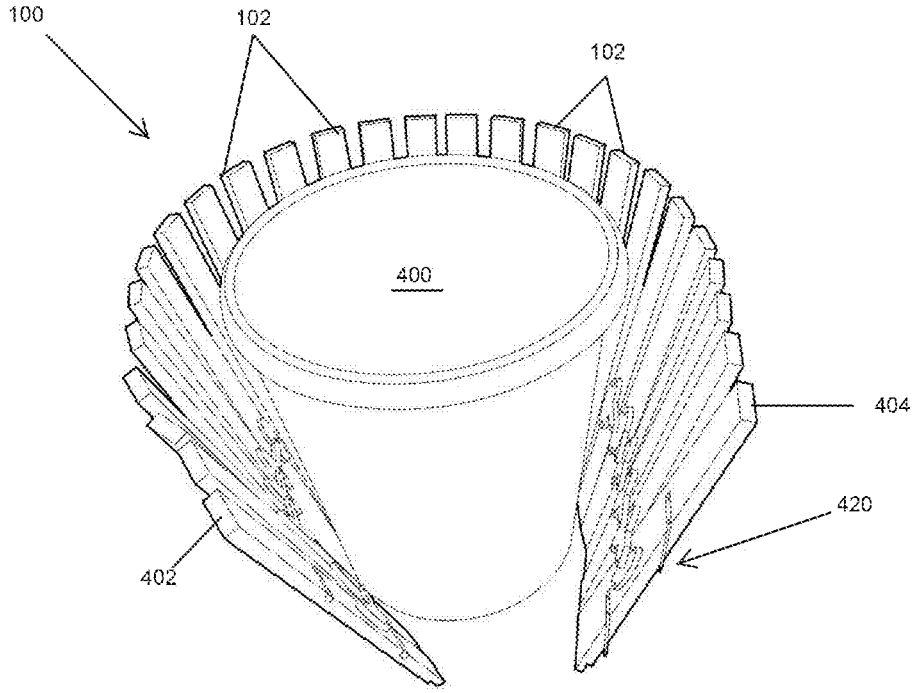
FIG. 4 illustrates the array of slats in FIG. 3 being wrapped nearly entirely around a container.

FIG. 1 is a top perspective view of one example of a decorative surround of the present invention. As illustrated in FIG. 1, the decorative surround 100 includes a plurality of slats 102 that are connected in a hinged manner that permits the slats 102 to create a hollowed circular opening for encircling a container 400 (FIG. 4).

Figure 2:
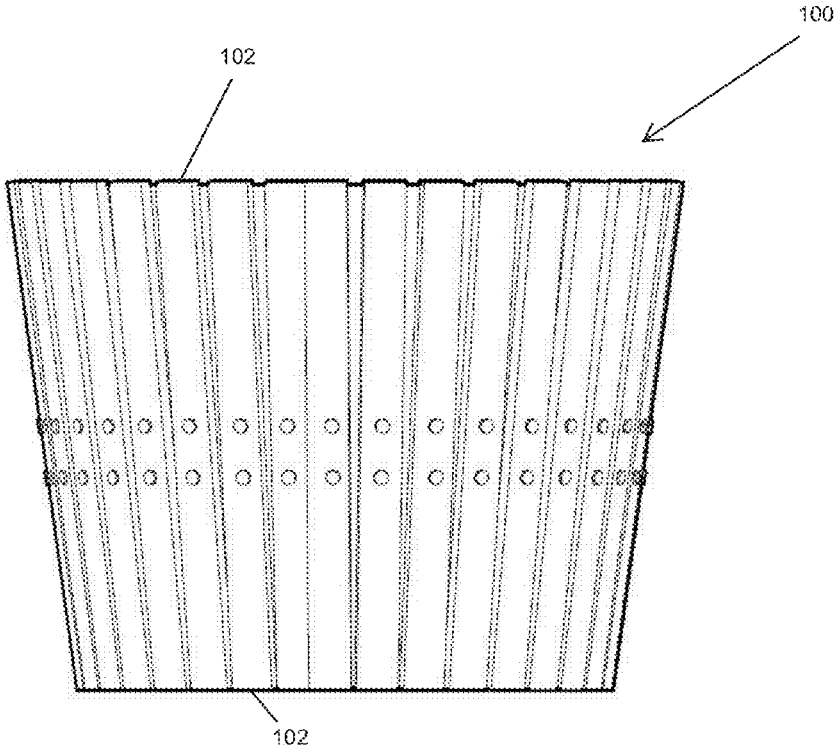
FIG. 2 is an elevation view of FIG. 1.

FIG. 2 illustrates an elevation view of the decorative surround 100 in FIG. 1. As illustrated in FIGS. 1 and 2, not only does the hinged connections between the slats 102 provide relative inward movement of the slats 102 so as to allow them to encircle an object, the hinged connection also facilitates some relative vertical angular movement between the slats 102, allowing the slat 102 at the bottom of the decorative surround 100 to move closer to one another, while gradually increasing the circumference of the opening formed by the slats at the top of the decorative surround 100.

Figure 3:
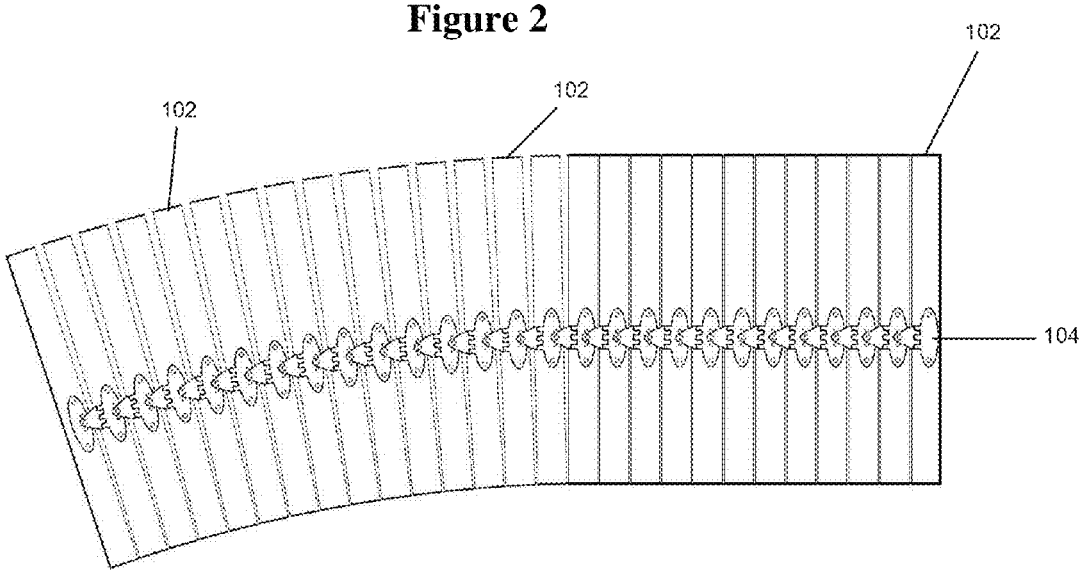
FIG. 3 illustrates one example of an array of slats used in the decorative surround of the present invention.

FIG. 3 illustrates one example of an array of slats 102 used in the decorative surround 100 in FIG. 1, shown in an unfolded position. FIG. 3 shows the interior side of the array of slats 102 that, when assembled, faces the container 400 (FIG. 4). The relative vertical angular movement between the slats 102 is best illustrated in FIG. 3.

To create the flaring of the decorative surround 100 when positioned around a tapered object, the slats 102 are interconnected with spaces therebetween and the hinged connection formed by fastening members 104 is offset to allow the slats 102 to be slightly angled relative to one another along the vertical axis (running lengthwise along the slats 102). The slats 102 in FIG. 3 are laid out on a flat surface showing the potential for curvature in the array on the left side of the array.

For purposes of this application, a "hinged connection" shall be a connection formed between two slat members 102 via a fastening mechanism 104. The fastening mechanism 104 can be any structure that forms a connection between the slats 102 and that allows the slats 102 to move inward relative to one another in a direction that enables the array of slats 102 to enclose an object. In certain applications, the fastening mechanism 104 also permits the relative vertical angular movement between slats 102 to create a tapered effect, where the slats 102 are positioned closer together at one end than the other end. A hinged connection can be any connection that allows for the parts to pivot relative to one another in any direction, including but not limited to, the horizontal direction, vertical direction or both.

FIG. 4 illustrates the array of slats 102 in the decorative surround 100 of FIG. 3 being wrapped nearly entirely around a container 400. As will be further illustrated below, the slats 102 may be, in one example, connected in a hinged manner so as to create space between the slats 102, whose spacing, flexibility and offset positioning allow for the slats 102 to flare at the top when placed around a tapered object. The opposing first and second ends 402 and 404 in the array of slats 102 may further be secured to one other by a variety of different securing mechanisms 420, as will be described further below.

Figure 5:
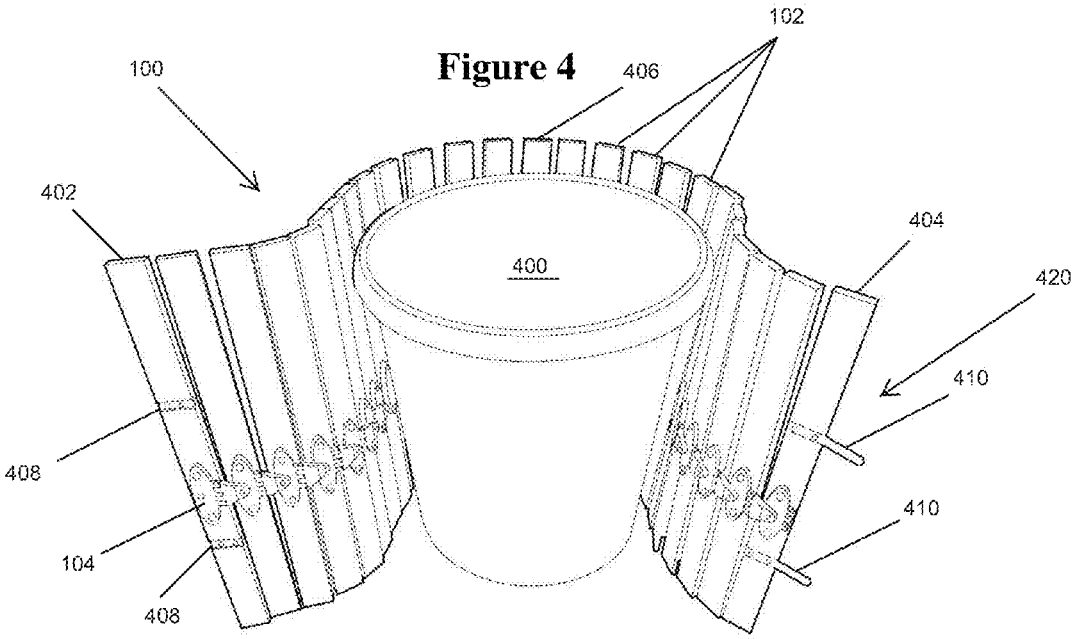
FIG. 5 illustrates another example of the array of slats in FIG. 3 being positioned around a container.

FIG. 5 illustrates the interior of the first and second ends 402 and 404 of the array of slats 102 as they are positioned around the container 400 before securing the first and second ends 402 and 404 together. In particular, FIG. 5 best illustrates the interior of the array of slats 102 with the fastening mechanisms 104 connecting the slats 102 and the securing mechanism 420. In this example, the securing mechanism 420 includes opposing recessed magnets 408 positioned on the slat 102 forming the first end of the array, 402. One magnet 408 is positioned on each side of the fastening mechanism 104. On the opposing slat 102 forming the second end of the array 404, magnetic strips 410 are secured to the slat 102 at positions that correspond to the magnets 408 on the first array end 402. The magnetic strips 410 are attached on the interior side of the slat 104 forming the second array end 404 and extend out beyond the second array end 404 to interconnect with the magnets 408 on the first array end 402. In this manner, the magnets 408 and magnetic strips 410 can maintain the array of slats 102 secured around the container 400.

Figure 6:
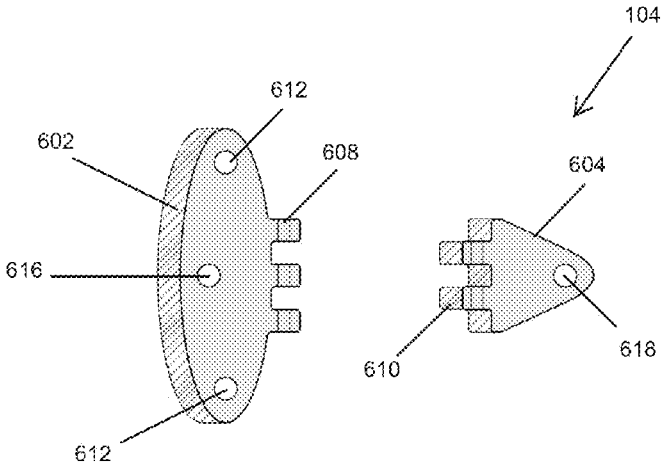
FIG. 6 illustrates one example of a fastening mechanism that may be used to create a hinged connection between slats of a decorative surround of the present invention.

FIG. 6 illustrates one example of a fastening mechanism 104 that may be used to create a hinged connection between slats 102 of the decorative surround 100 of the present invention. In this example, the fastening mechanism 104 includes a base plate 602 that is connected in a hinged fashion to an overlap plate 604. The base plate 602 includes upper and lower holes 612 for securing the base plate 602 to the slats 102. A central opening 616 is also positioned between the upper and lower holes 612 along the base plate 602 for securing the base plate 602 to adjacent overlap plates 604 that extend from adjacent base plates 602 secured to adjacent slats 102. The base plate 602 includes raised hinged teeth members 608 that interconnect with offset hinged teeth members 610 on the overlap plate 604. The pin (not shown) runs through the raised hinged teeth members 608 on the base plate 602 and the offset hinged teeth members 610 on the overlap plate 604 when interconnected to create a hinged connection between the base plate 602 and the overlap plate 604. In this manner, the overlap plate 604 is connected in a hinged fashion and in a raised position above the base plate 602.

By connecting the overlap plate 604 in a raised position above the base plate 602, the overlap plate 604 rests over the top of adjacent base plates 602 positioned on adjacent slats 102 when the slats 102 are aligned in an array (see FIG. 3). The overlap plate 604 is connected to adjacent base plates 602 through the hole 618 on the overlap plate 604 that allows the overlap plate 608 to connect to the central opening 616 in an adjoining base plate 604. A pin or quick release type fastener may be used to connect the overlap plate 604 to adjacent base plates 604. Connecting adjacent slats 102 in this manner allows for the array of slats 102 to be easily expanded or decreased in size, as needed, creating a modular decorative surround for use in connection with any size container 400.

Figures 7A, 7B, 7C:
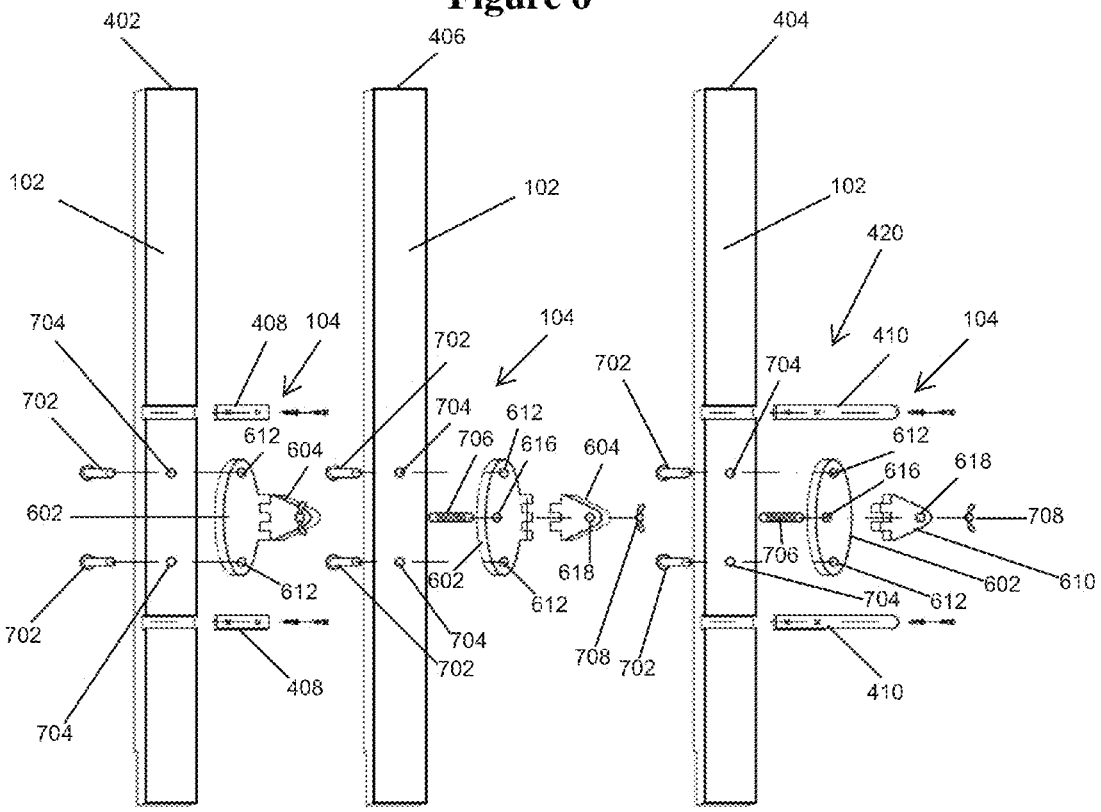
FIG. 7*a* illustrates an exploded view of one example of a construction of a first end of an array of slats in FIG. 5. array.
FIG. 7*b* illustrates an exploded view of one example of a construction of a slat found in the central portion of the array of slats in FIG. 5.
FIG. 7*c* illustrates an exploded view of one example of a construction of a second end of an array of slats in FIG. 5.

FIGS. 7*a*, 7*b* and 7*c* illustrate exploded views of slats 102 with interconnecting hardware that form the first end 402 of the array, a central portion 406 of the array and the second end 404 of the array of the decorative surround 100 shown in FIGS. 4-5 above.

In particular, FIG. 7*a* illustrates an exploded view of one example of a slat 102 that forms a first end 402 of the array 102 used in connection with the decorative surround 100 of the present invention. FIG. 7*a* illustrates the placement of the fastening mechanism 104 in an offset position along the slat 102 that represents the first end of the array 402 of slats 102. As illustrated, the base plate 602 is secured to the slat 102 in an offset manner (just below center). The base plate 602 is affixed to corresponding holes 704 in the slat 102 through upper and lower holes 612 in the base plate 602 using fasteners 702. FIG. 7*a* also illustrates the recesses in the slat 102 on each side of the fastening mechanism 104 for the placement of magnets 408.

FIG. 7*b* illustrates an exploded view of one example of a slat 102 located in the central or interior portion of the array 406 of slats 102 that may be used in connection with the decorative surround 100 of the present invention. FIG. 7*a* shows the placement of the fastening mechanism 104 onto a slat found in the central or interior portion 406 of the array of slats 102. As illustrated, the fastening mechanism 104 affixes to the slat 102 positioned in the central portion 406 of the array in the same manner as it affixes to the slats 102 that form the first end member 402.

FIG. 7*c* illustrates an exploded view of one example of a slat 102 that forms a second end 404 in an array of slats 102 that may be used in connection with the decorative surround 100 of the present invention. FIG. 7*c* illustrates that the construction of the second end 404 of the array of slats 102 is the same as that of the first end 402 in the array. The only distinction is that the magnets 408 are instead replaced with magnetic strips 410. The magnetic strips 410, together with the magnets 408 in the slat 102 in the first end 402 of the array, form the securing mechanism 420 that maintains the decorative surround 100 in a closed position about an object. Further, if the slat 102 is functioning as the second end 404 of the array, the overlap plate 604 is not needed, and would be excluded, so as not to interfere with the securing mechanism 420. The array of slats 102 can be expanded or reduced by adding or subtracting slats internal to the array so as not to disturb or alter the construction of the first and second end members 402, 404 of the array.

Figure 8:
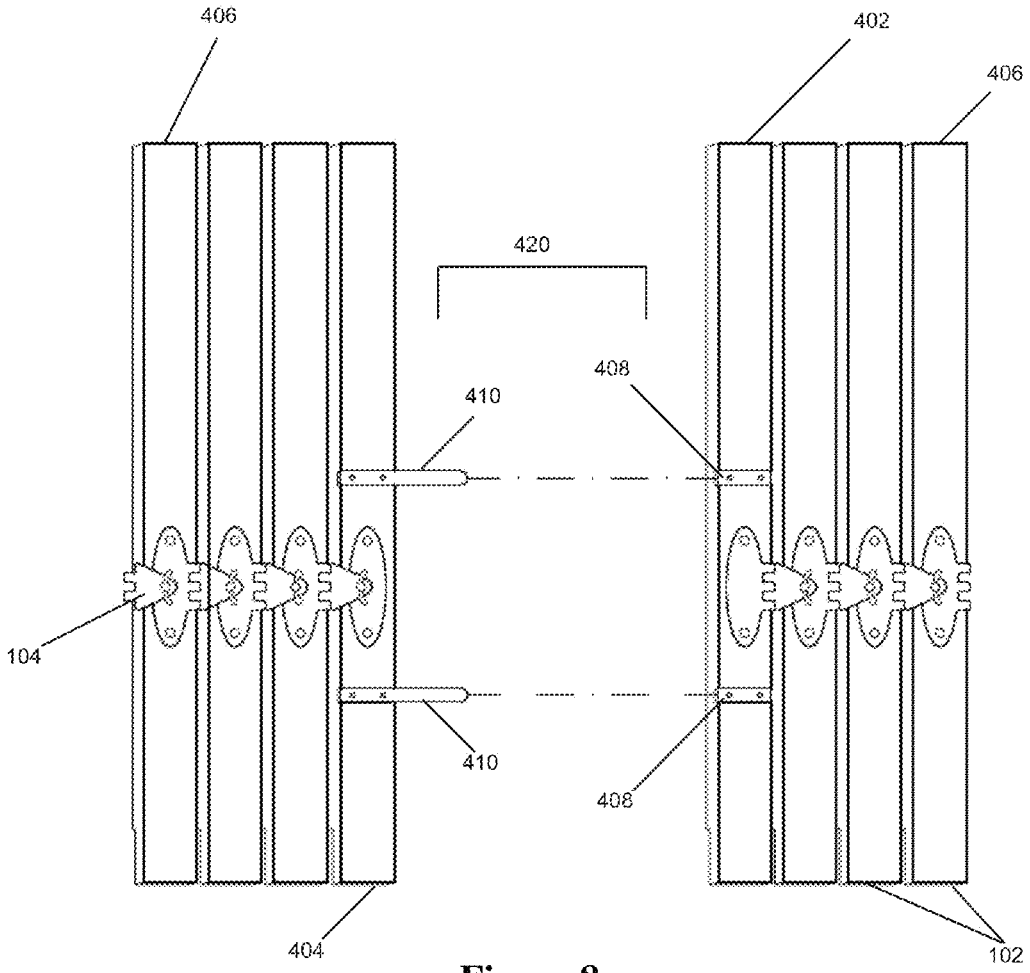
FIG. 8 illustrates one example of a securing mechanism used to secure the first end slat member in an array to a second end slat member of the array.

FIG. 8 illustrates one example of a securing mechanism 420 used to secure the first end 402 and second end 404 of the array of slats 102. FIG. 8 illustrates the mating of the securing mechanism 420 in one example of the present invention. In this example, the securing mechanism 420 is a magnetic connection comprising magnets and corresponding magnetic strips 408 and 410. As illustrated in FIG. 8, the magnetic strips 410 may be positioned on one end of the array 402 and the magnets 408 may be positioned on the opposing end of the array 404. The interconnection and attraction between the magnets 408 and magnetic strips 410 when aligned along adjacent slats secures the array ends 402 and 408 of the slats 102 to one another.

Figure 9:
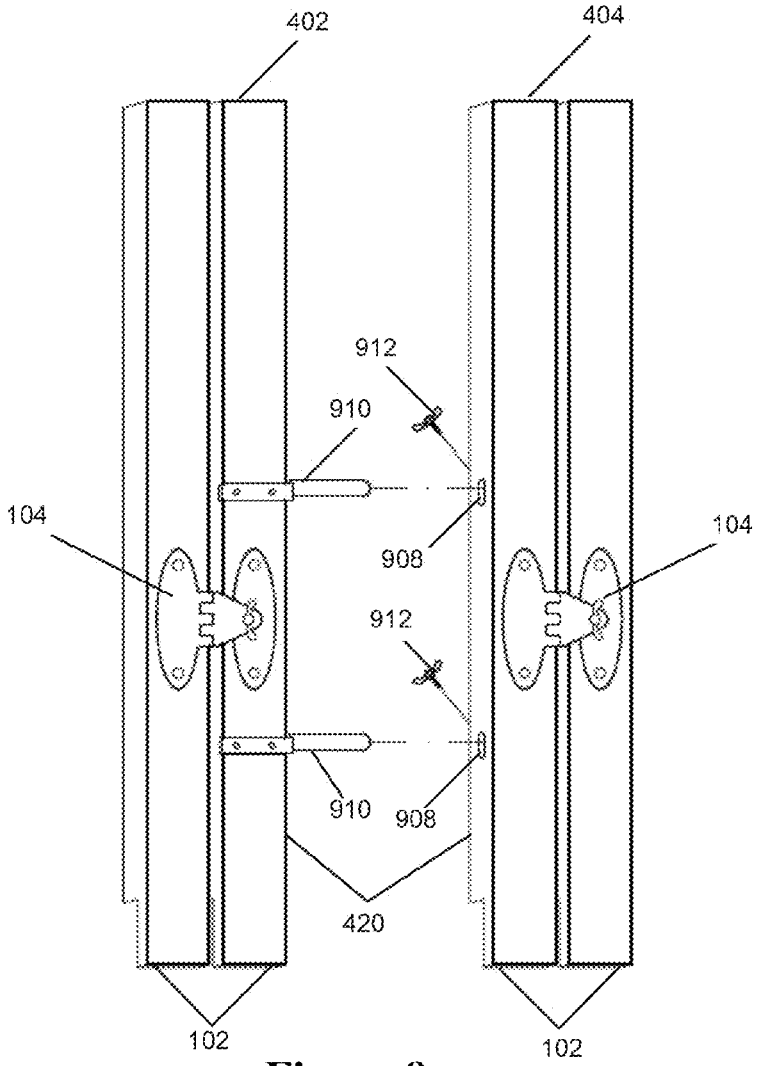
FIG. 9 illustrates another example of a securing mechanism used to secure the first end slat member in an array to a second end slat member of the array.

FIG. 9 illustrates another example of a securing mechanism 420 to secure the first end 402 of the array of slats 102 to the second end 404 of the array of slats. In this example, the first end 402 of the array may include opposing strips made of metal, plastic, canvas, fabric, wire, rope, chain, nylon, elastic, or other material capable of being secured against the slat 102 on the first end 402 of the array. The opposing slat 102 on the second end of the array 404 may include openings 908 along the side of the slat 102 for receiving the strips 910. The strips 910 may then be positioned within the openings 908 of the slat 102 and secured to the slat 102 with fasteners 910 once the strips 910 are positioned within the openings 908 of the opposing slat 102.

Figure 10:
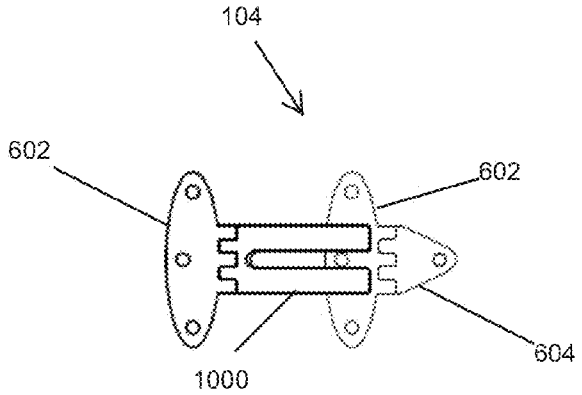
FIG. 10 illustrates another example of a fastening mechanism of the present invention.

FIG. 10 illustrates another example of a fastening mechanism 104 that may be used in connection with the present invention. The fastening mechanism 104 creates a hinged and slideable connection between the fastening members 104. This fastening mechanism 104 may be used also as a securing mechanism 420 on the interior or exterior side of the array. It may be used in place of, or in connection with, the fastening mechanism 104 illustrated in FIG. 6 above. In this example, the fastening mechanism 420 includes a modified overlap plate 606 that includes a slot, rather than a hole, for creating a sliding connection. The slot may extend to the end of the modified overlap plate 606, as shown, or may be confined to the interior of the modified overlap plate 606 only. The modified overlap plate 606 may be secured to the adjacent base plate 602 by any type of fastener, including but not limited to pins, nuts, bolts, quick release fasteners and the like.

Figure 11A:
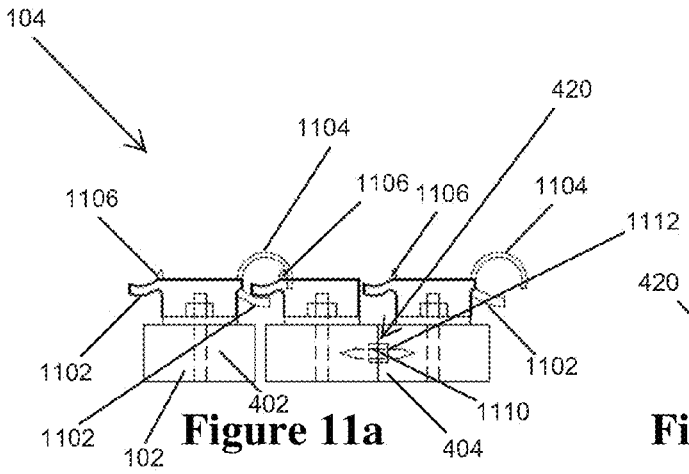
FIG. 11*a* illustrates a cross-section of three slat members in an array connected by another example of a fastening member.

FIG. 11*a* illustrates a cross-section of three slat members 102 in an array connected together via another example of a fastening mechanism 104. In this example, the fastening mechanism 104 is bolted to the slat 102 and includes, at one end, a flanged edge 1102 and at the other end, a loop member 1104. An upwardly extending locking mechanism 1106, located near the flanged edge 1102, holds the flanged member 1106 of one fastening member 104 in the opposing loop member 1104 of an adjacent fastening mechanism 104. By maintaining the flanged member 1106 in an opposing loop member 1104, a hinged connection between the slats 102 is created. In this manner, slats 102 may be easily added or subtracted from an array to change the length of the array to accommodate planters of varying sizes.

Figure 11B:
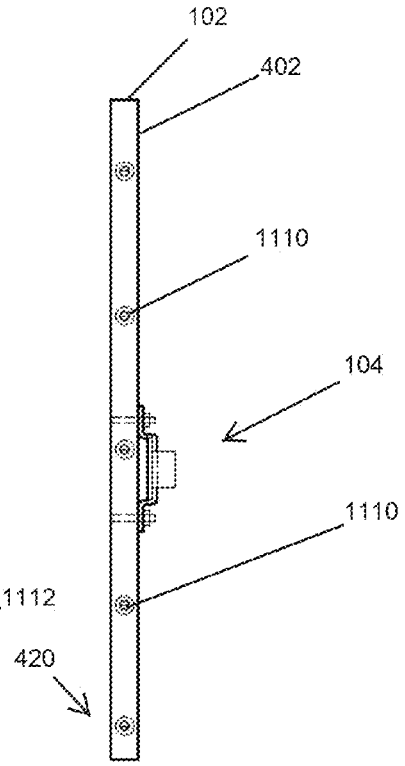
FIG. 11*b* illustrates a side view of a slat member in FIG. 11*a*.

Further, this example illustrates, in connection with FIG. 11*b*, another example of a securing mechanism 420. In this example, the slats 102 on the ends 402, 404 of the array may contain magnets 1110, 1112 positioned on opposing sides of the array ends 402 and 404 and may be used to secure the decorative surround 100 around a container. As seen in FIG. 11*a*, the two center slats 102 are joined together along the opposing sides of the slats 102 by magnets 1110, 1112. These magnets 1110, 1112 allow the array to interconnect at its ends 402, 404 by joining the opposing slats 102.

FIG. 11*b* is a side view of one slat 102 of the decorative surround 100 illustrated in FIG. 11*a*. FIG. 11*b* further illustrates the offset placement of the fastening mechanism 104 slightly below the horizontal center (with the horizontal axis defined along the axis of the width) to allow for the relative angular movement between the slats 102. In this manner, the slats 102 can flare at the top when positioned around a tapered container. Further, FIG. 11*b* illustrates magnets 1110 positioned along the side of the slat 102. These magnets 1110 are designed to connect with opposing pole magnets 1112 positioned along the opposing side of another slat 102 to allow the slat array to adjoin along opposing ends 402, 404 when wrapped around a container.

Figure 12:
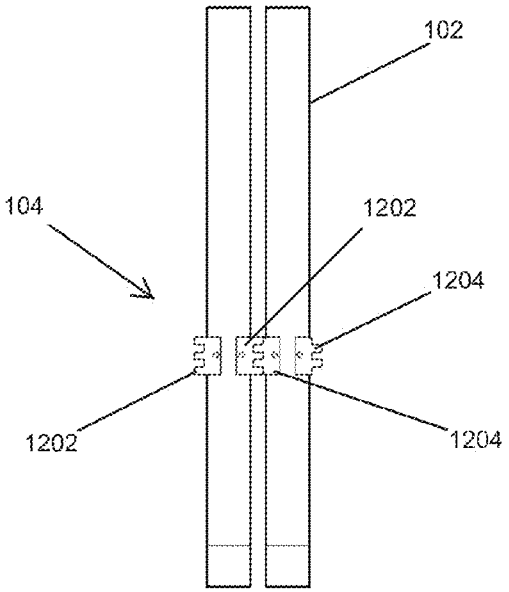
FIG. 12 illustrates another example of a fastening mechanism forming a hinged connection between slats in an array.

FIG. 12 illustrates yet another example of a fastening mechanism 104 forming a hinged connection between slats 102 in the array. As illustrated in FIG. 12, the fastening mechanism 104 may comprise a plate 1202 having teeth that interconnect with teeth on an opposing plate 1204. A pin (not shown) can then be positioned through the opposing teeth on plates 1202 and 1204 to create the hinged connection. As illustrated, the plates 1202, 1204 are positioned on the slats 102 such that the teeth extend outward, beyond the side edge of the slats 102. When adjoined, the plates 1202, 1204, create a space between the slats 102 for relative movement between the slats 102.

Figure 13:
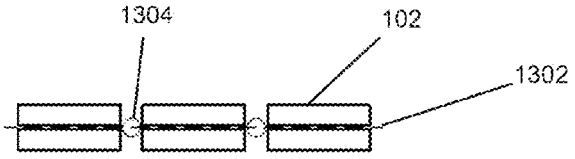
FIG. 13 illustrates the cross-section of an array of slats showing another example of a hinged connection between slats in an array.
Figure 14A:
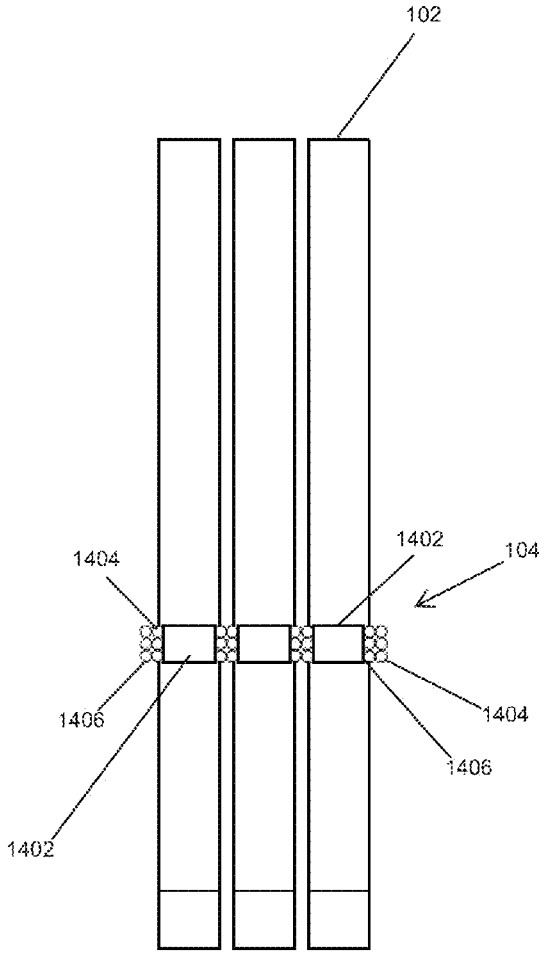
FIG. 14*a* illustrates one example of a hinge connection formed by a magnetic fastening member.

FIG. 13 illustrates the cross-section of an array of slats showing another example of a hinged connection between slats 102 in an array. As illustrated in FIG. 13, the slats may include internal, horizontally aligned holes across the slats 102, extending from one side of the slat 102 to the other. A wire 1302 may then be run through the holes of the slats 102, adjoining adjacent slats 102. The wire 1302 would extend from one side of the slat through the other. Spacer 1304 may be positioned along the wire 1302, between the slats, as illustrated in FIG. 13, to create space between the slats 1302 and further facilitate a hinged connection between slats 102. The connected array of slats 102 may then be secured together at its ends by a securing mechanism 420, as will be further explained below.

FIGS. 14 through 17 illustrate a variety of additional ways in which magnets may be used to create hinged connections between slats 102. In particular, FIG. 14*a* illustrates one example of a hinge connection formed by a magnetic fastening member 104. FIG. 14*b* illustrates a plan view of the slat array of FIG. 14*a* with the magnetic fastening member 104. In this example, a plate 1402, having ball magnets of opposing poles on each side 1404, 1406, may be secured to each slat 102, so as to enable the magnetic connection between the slats 102 in a manner that creates a hinged connection between slats. The plate 1402 is sized to be substantially the same width as the slat 102 such that the side ball magnets not only create a hinged connection, but also provide space between the slats 102.

Figure 15A:
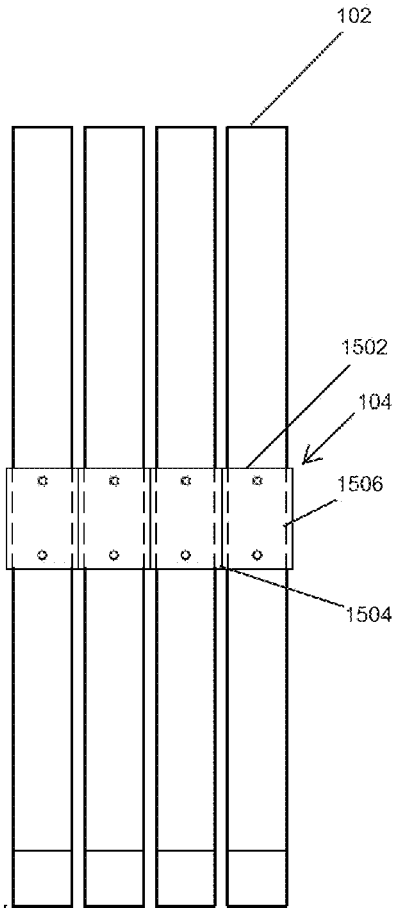
FIG. 15*a* illustrates another example of a hinge connection formed by a magnetic fastening member.
Figure 14B:
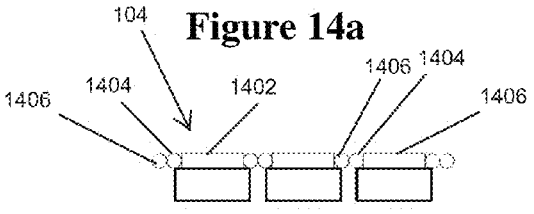
FIG. 14*b* illustrates a plan view of the slat array of FIG. 14*a*.
Figure 15B:
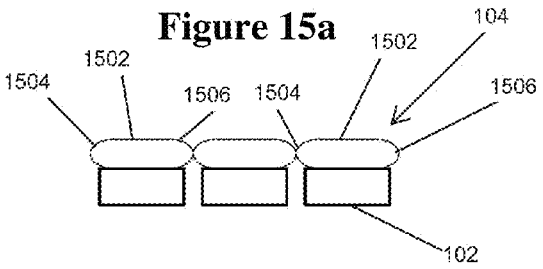
FIG. 15*b* illustrates a plan view of the slat array in FIG. 15*a*.

FIG. 15*a* illustrates another example of a hinge connection formed by magnetic fastening members 104. FIG. 15*b* illustrates a plan view of the slat array in FIG. 15*a* with the magnetic fastening members 104 attached. In this example, a plate 1502, having rounded corners with opposing magnetic poles on each side 1504, 1506, may be secured to each slat 102, so as to enable the magnetic connection between the slats 102 in a manner that creates a hinged connection between slats. The plate 1502 is sized to be larger than the width of a slat 102 such that the sides extend out past the edge of the slats 102. By extending the rounded corners of the plate 1502 beyond the side edges of the slats 102, the magnetic corners 1504, 1506 not only create a hinged connection, but also provide space between the slats 102.

Figure 16A:
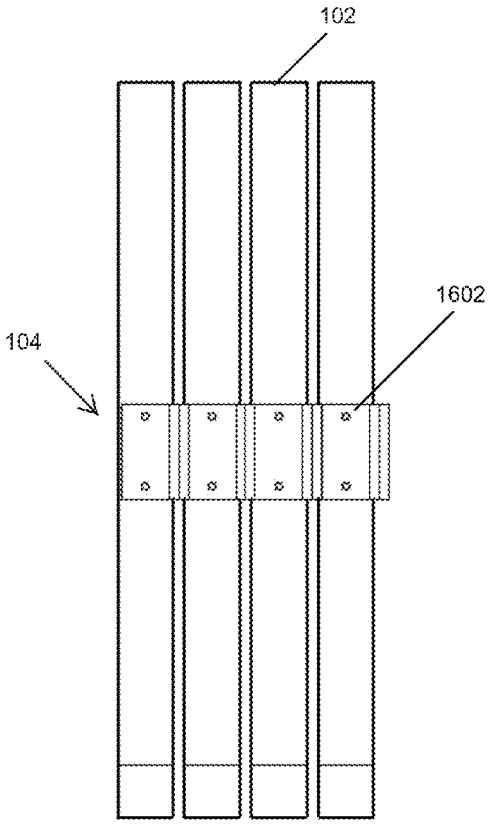
FIG. 16*a* illustrates yet another example of a hinge connection formed by a magnetic fastening member.
Figure 16B:
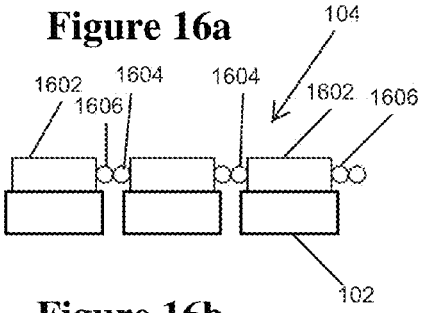
FIG. 16*b* illustrates a plan view of the slat array in FIG. 16*a*.

FIG. 16*a* illustrates yet another example of a hinge connection formed by magnetic fastening members 104. FIG. 16*b* illustrates a plan view of the slat array in FIG. 16*a* with the magnetic fastening members 104 attached. In this example, a plate 1602, having cylindrical magnets of opposing poles on each side 1604, 1606, may be secured to each slat 102, so as to enable the magnetic connection between the slats 102 in a manner that creates a hinged connection between slats. The plate 1602 is sized to be substantially the same width as the slat 102 such that the cylindrical magnets 1604, 1606 not only create a hinged connection, but also provide space between the slats 102.

Figure 17A:
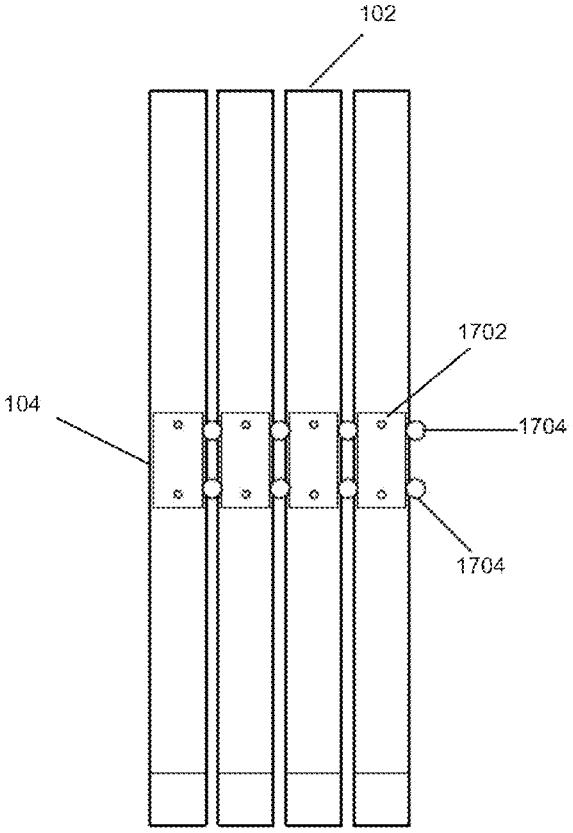
FIG. 17*a* illustrates a further example of a hinge connection formed by a magnetic fastening member.
Figure 17B:
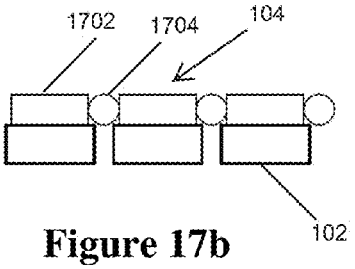
FIG. 17*b* illustrates a plan view of the slat array in FIG. 17*a*.

FIG. 17*a* illustrates a further example of a hinge connection formed by a magnetic fastening member 104. FIG. 17*b* illustrates a plan view of the slat array in FIG. 17*a* with the magnetic fastening members 104 attached. In this example, the plates 1702 include at least one ball magnet 1704 therebetween. The plates 1702 can be magnetic and the ball magnets 1704 may be of opposite magnetic pole from the plates 1702. Alternatively, the ball magnets 1704 can be attached to one side of the plates 1702 with the opposing plate ends 1704 and ball magnet 1704 attracting one another. The plate 1702 may be secured to each slat 1702 such that the ball magnets 1704 are positioned between the slats 102, creating a hinged connection between slats 102. The plate 1702 is sized to be substantially the same width as the slat 102 such that the ball magnets 1704 not only create a hinged connection, but also provide space between the slats 102.

Figure 18A:
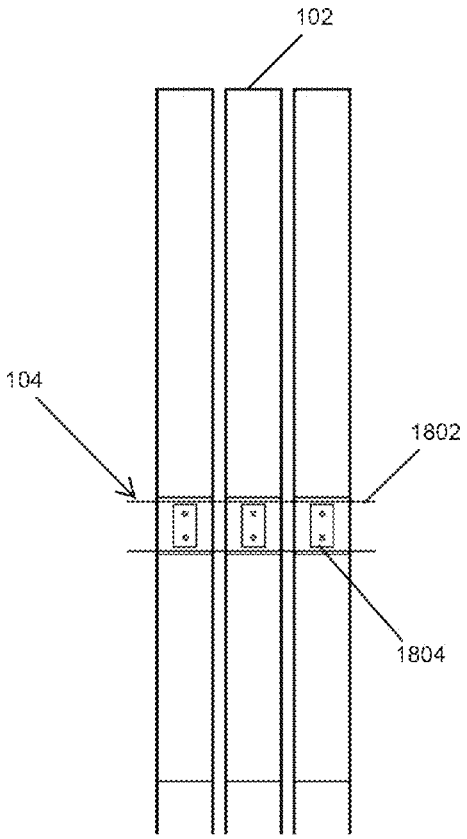
FIG. 18*a* illustrates another example of a fastening mechanism that may be used to create a hinge connection between the slats in the array of the decorative surround of the present invention.
Figure 19A:
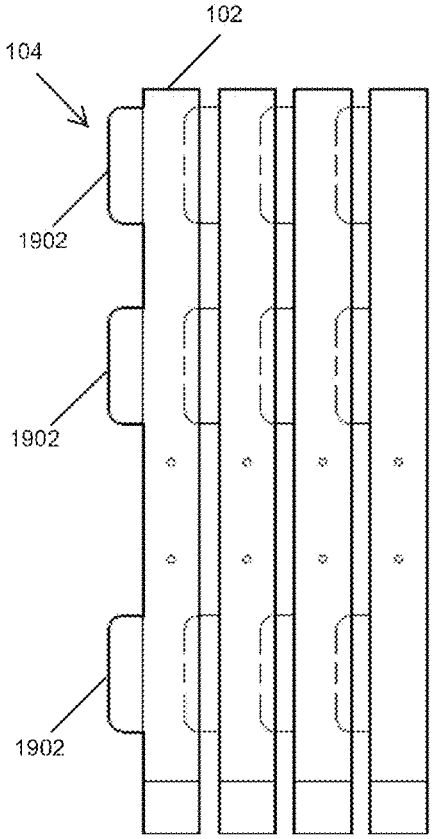
FIG. 19*a* illustrates another example of a fastening mechanism that may be used to create a hinge connection between the slats in the array of the decorative surround of the present invention.
Figure 18B:
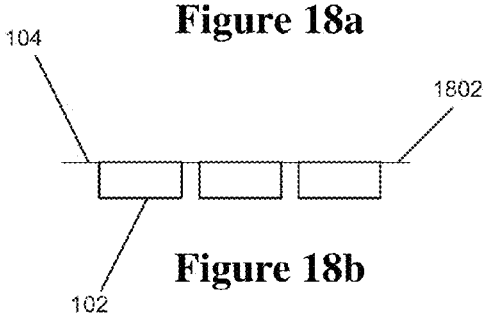
FIG. 18*b* illustrates a plan view of the slat array in FIG. 18*a*.
Figure 19B:
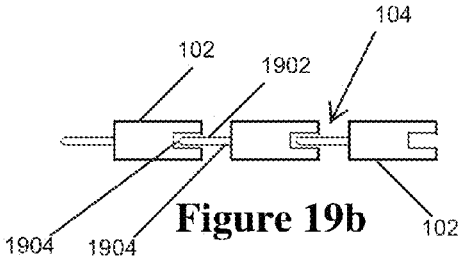
FIG. 19*b* illustrates a cross-sectional plan view of the slat array of FIG. 19*a*.

FIG. 18*a* illustrates another example of a fastening mechanism 104 that may be used to create a hinge connection between the slats 102 in the array of the decorative surround 100 of the present invention. FIG. 18*b* illustrates a plan view of the slat array of FIG. 18*a*, with a fastening mechanism 104 attached. In this example, a flexible strip 1802 may be secured across the slats 102. The flexible strip 1802 is secured directly to the slats 102 with a fastener, such as a plate 1804 secured on top of the flexible strip 1802, thereby securing the strip 1802 against the slat 102. The flexible strip 1802 may be made of any type of flexible material of sufficient strength to maintain the slats 102 together in an array. The array is formed with spaces between the slats 102 to allow for relative movement between the slats 102. Such flexible strip 1802 material may include, but not be limited to plastic, metal wire, rope, chain, nylon, elastic and/or fabric made of natural or synthetic fibers. FIG. 19*a* illustrates another example of a fastening mechanism 104 that may be used to create a hinge connection between the slats 102 in the array of the decorative surround 100 of the present invention. FIG. 19*b* illustrates a cross-sectional plan view of the slat array of FIG. 19*a*. In this example, the slats 102 include flexible tabs 1902 extending from the sides of the slats 102. The sides of the slats opposing the flexible tabs 1902 include recesses 1904 for receiving the flexible tabs 1902 on adjoining slats 102. The flexible tabs 1902 may be secured in the recesses by any known fastening means to adjoin the slats 102. The flexible tabs 2002 may be made of the same or different material from the slat 102. The flexible tabs 1902 may be constructed of plastic, metal, fiberboard, acrylic, rubber, composite fibers, leather, hairs or any like material.

Figures 20A, 21, 22:
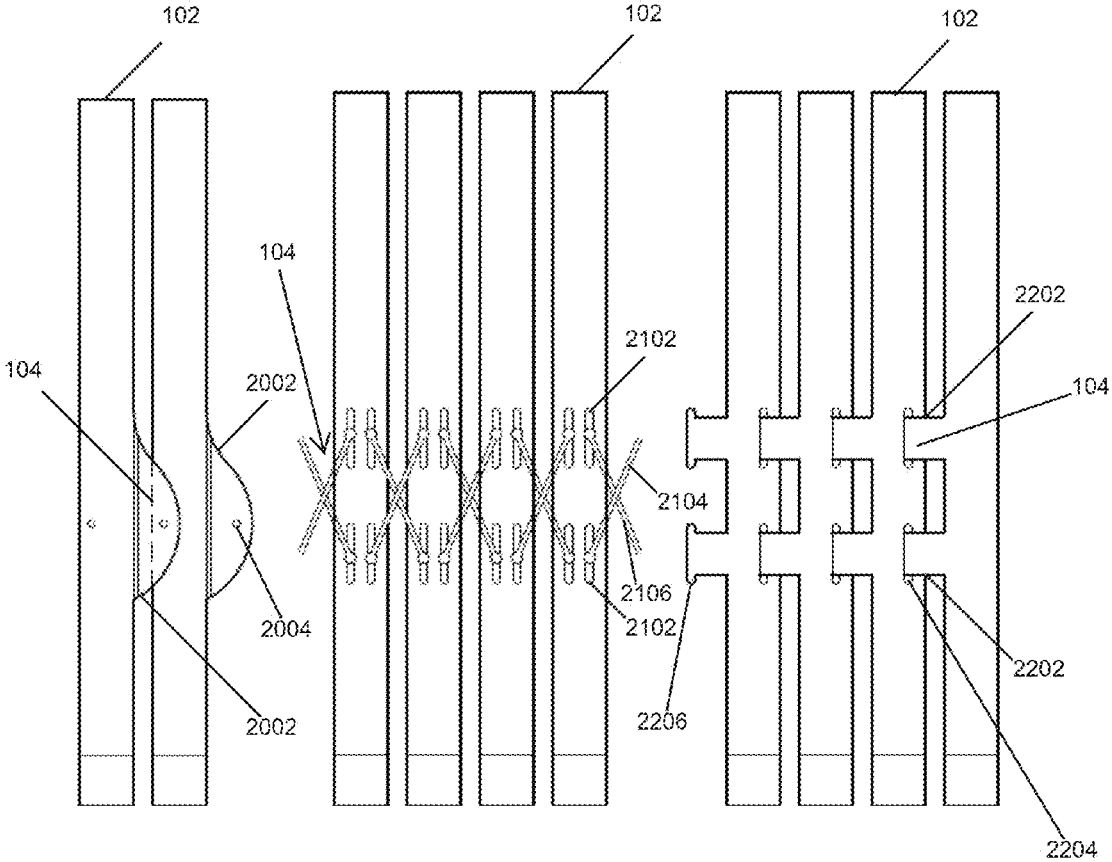
FIG. 20*a* illustrates yet another example of a fastening mechanism that may be used to create a hinge connection between the slats in the array of the decorative surround of the present invention.
FIG. 21 illustrates another example of a fastening mechanism for creating a hinged connection between the slats in the array.
FIG. 22 illustrates yet another example of a fastening mechanism for creating a hinged connection between the slats in the array.
Figure 20B:
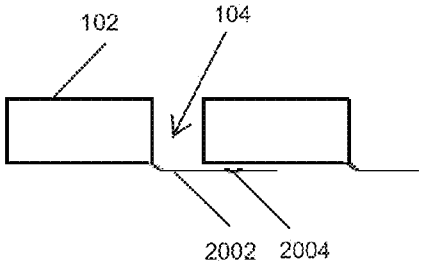
FIG. 20*b* illustrates a plan view of the slat array in FIG. 20*a*.

FIG. 20*a* illustrates yet another example of a fastening mechanism 104 that may be used to create a hinge connection between the slats 102 in the array of the decorative surround 100 of the present invention. FIG. 20*b* illustrates a plan view of the slat array in FIG. 20*a*. Similar to FIGS. 19*a* and 19*b*, the slats 102 may include flexible tabs 2002 that extend from one side edge of the slat 102. The flexible tabs 2002, in this example, are designed to be on the front or back edge of one side of the slats 102 such that the flexible tabs 2002 lie on top of adjacent slats. The flexible tabs 2002 include at least one hole 2004 for securing the tabs 2002 to adjoining slats 102 in a spaced relationship to one another so as to create a hinged connection between the slats 102, permitting relative movement between the slats 102. The flexible tabs 2002 may be made of the same or different material from the slat 102 and may, for example, be constructed of metal, plastic, acrylic, nylon, sheet metal, "living hinge" or like material.

FIG. 21 illustrates another example of a fastening mechanism for creating a hinged connection between the slats in the array. In the example, it is shown that the slats 102 may be held together to create a hinged connection by threading wire, plastic, rope, rods or fabric 2104, 2106 through slots 2102 in the slats 102.

FIG. 22 illustrates yet another example of a fastening mechanism for creating a hinged connection between the slats in the array. In this example, it is shown that the slats 102 may interconnect in spaced relationship with one another to create a hinged connection through the use of extension tabs 2202 that snap-fit into recesses 2204 in adjacent slats 102. The tabs 2202 can be made of any suitable flexible material, such as plastic, leather, metal, nylon or fiberboard to create a snap-fit with adjacent slats 102.

Figure 23A:
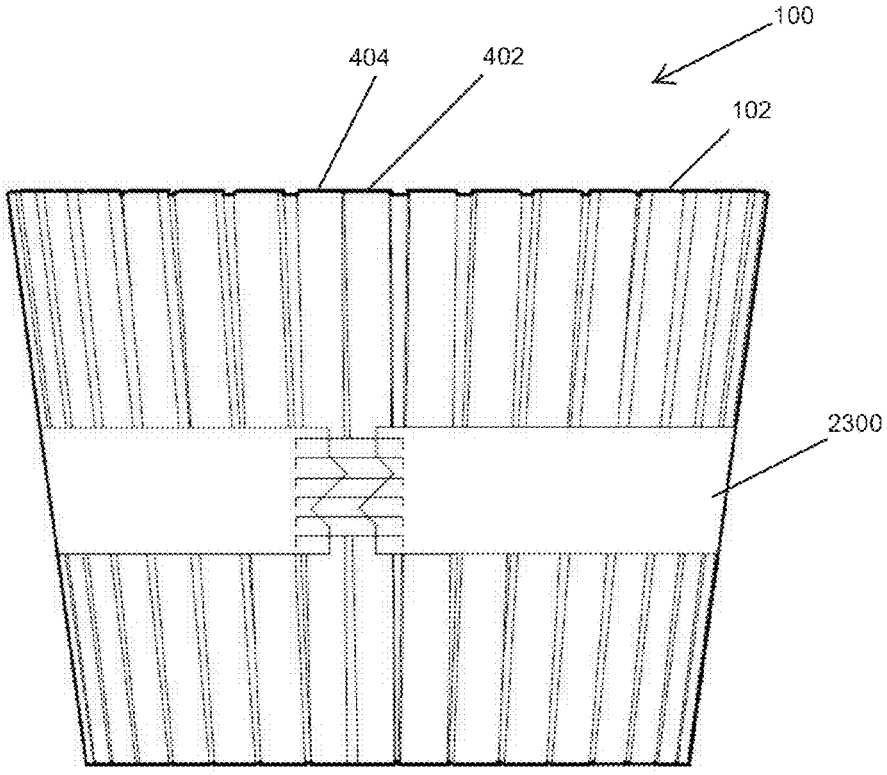
FIG. 23*a* illustrates one example of a securing mechanism for securing the array of slats around an object.
Figure 23B:
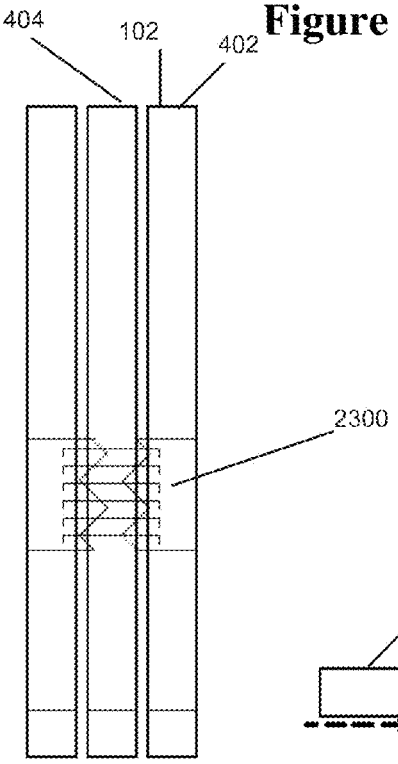
FIG. 23*b* illustrates an elevation view of the securing mechanism as it would appear adjoining the first and second array ends.
Figure 23C:
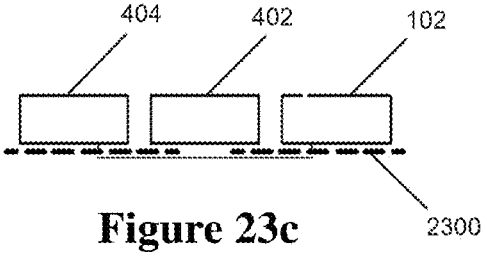
FIG. 23*c* illustrates a plan view of FIG. 23*b*.

FIG. 23*a* illustrates one example of a securing mechanism 420 for securing the first and second ends 402, 404 of an array of slats 102 together around an object. FIG. 23*b* illustrates an elevation view of the securing mechanism as it would appear adjoining the first and second array ends 402, 404. FIG. 23*c* illustrates a plan view of FIG. 23*b*. In this example, the securing mechanism 420 is an elastic band positioned around the array of slats 102.

FIG. 24*a* illustrates another example of a securing mechanism 420 for securing the array of slats 102 around an object. FIG. 24*b* illustrates an elevation view of the securing mechanism as it would appear adjoining the first and second array ends 402, 404. FIG. 24*c* illustrates a plan view of FIG. 24*b*. As illustrated in FIGS. 24*a*, 24*b*, and 24*c*, the securing mechanism 420 may be a tie 2400 wrapped around the exterior of the decorative surround 100. The tie 2400 may also be comprised of two pieces, each affixed to one end of the slat array 402, 404 and tied then together to secure the ends of the slat array 402, 404 to one another.

Figure 25A:
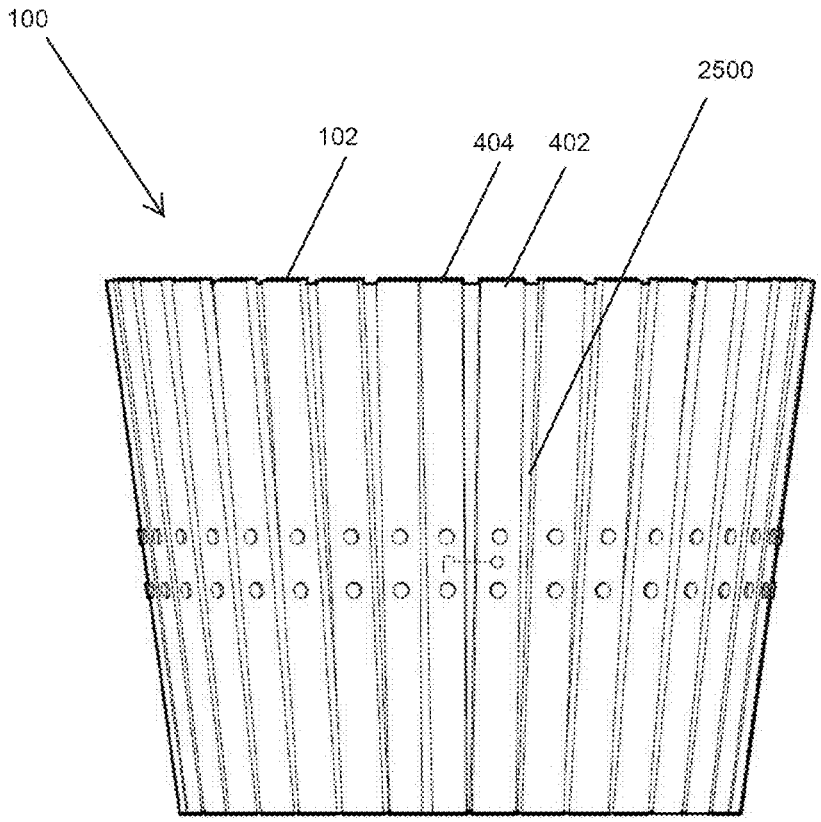
FIG. 25*a* illustrates one example of a securing mechanism for securing the array of slats around an object.
Figure 25B:
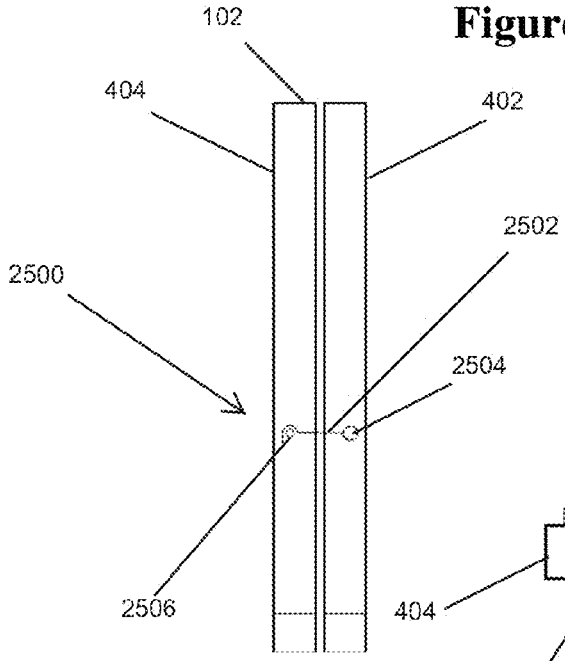
FIG. 25*b* illustrates an elevation view of the securing mechanism as it would appear adjoining the first and second array ends.
Figure 25C:
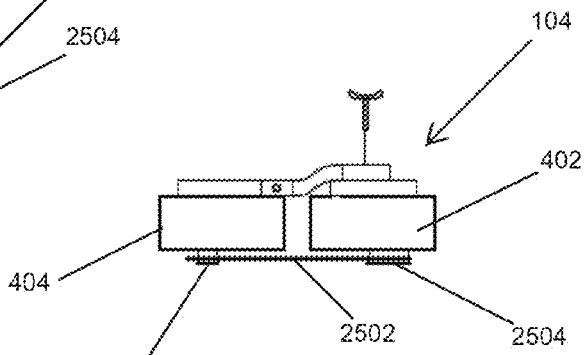
FIG. 25*c* illustrates a plan view of FIG. 25*b*.

FIG. 25*a* illustrates one example of a securing mechanism 420 for securing the array of slats 102 around an object. FIG. 25*b* illustrates an elevation view of the securing mechanism 420 as it would appear adjoining the first and second array ends 402, 404. FIG. 25*c* illustrates a plan view of FIG. 25*b*. As illustrated in FIGS. 25*a*, 25*b*, and 25*c*, the securing mechanism 420 may be a latch 2500. The latch 2500 may include an arm member 2502 having a loop end. The arm member 2502 may be pivotally connected to one end 404 of the array of slats at pivot connection 2504. The arm then latches to a pin 2506 located on an opposing end of the array of slats.

Figure 26:
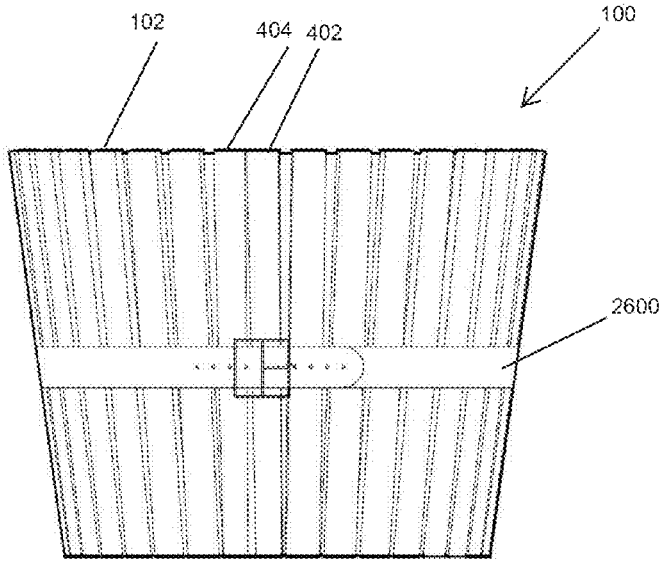
FIG. 26 illustrates yet another example of a securing mechanism for securing the array of slats around an object.
Figure 27A:
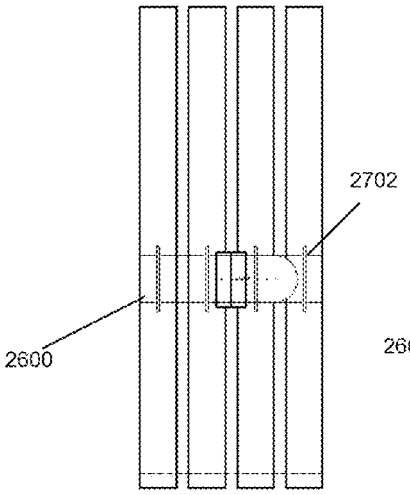
FIG. 27*a* illustrates an elevation view of the securing mechanism as it would appear adjoining the first and second array ends.
Figure 28A:
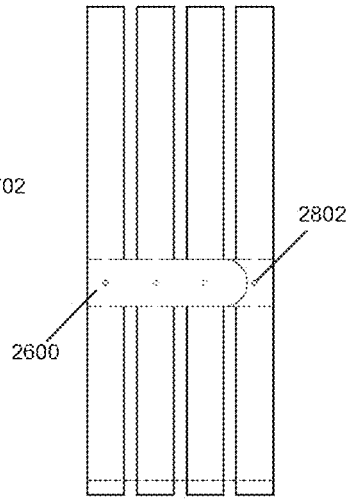
FIG. 28*a* illustrates an elevation view of the securing mechanism as it would appear adjoining the first and second array ends.
Figure 29A:
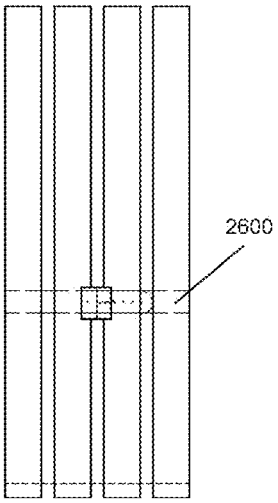
FIG. 29*a* illustrates an elevation view of the securing mechanism as it would appear adjoining the first and second array ends.
Figure 27B:
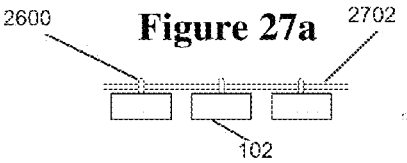
FIG. 27*b* illustrates a plan view of FIG. 25*b*.
Figure 28B:
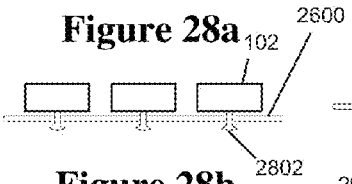
FIG. 28*b* illustrates a plan view of FIG. 25*b*.
Figure 29B:
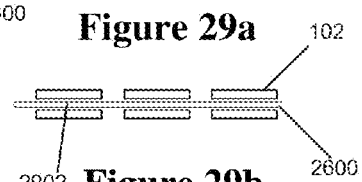
FIG. 29*b* illustrates a plan view of FIG. 25*b*.

FIG. 26 illustrates yet another example of a securing mechanism for securing the array of slats around an object. The securing mechanism includes a strap or tie 2600 that may wrap around the array of slats 102. FIGS. 27*a*, 27*b*, 28*a*, 28*b* and 29*a* and 29*b* illustrate different ways the strap or tie 2600 may be secured to the array. In particular, FIGS. 27*a* and 27*b* show the strap or tie 2600 held against the slats 102 by straps 2702, similar to loops on pants to hold a belt. FIGS. 28*a* and 28*b* show the strap 2600 being secured to the slats by fasteners 2802, such as rivets, pins, screws or the like. FIGS. 29*a* and 29*b* illustrate the strap 2702 positioned through interior slots extending through the sides of the slats. In the examples illustrated in FIGS. 26-29, the strap 2600 may function as both the securing mechanism 420 and the fastening mechanism 104, or may be used in connection with separate fastening mechanisms 104 for securing the slats together in a hinged manner. In all the above examples, the strap 2600 may be secured at opposing ends by ties or buckles. The strap 2600 may be made from a variety of flexible materials, such as metal, plastic, leather, nylon, canvas, chain, sheet metal, rope, rubber, elastic and fabric (natural or synthetic).

Figure 30:
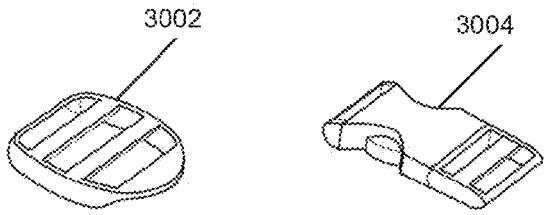
FIG. 30 illustrates examples of fasteners that may be used in connection with the securing mechanism.
Figure 31:
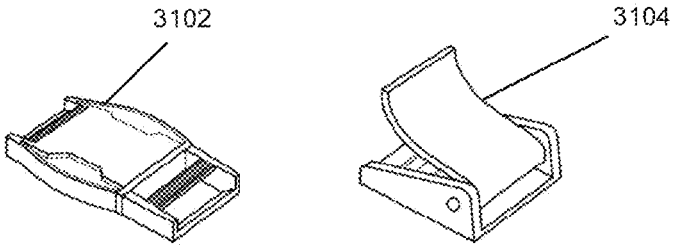
FIG. 31 illustrates other examples of fasteners that may be used in connection with the securing mechanism.

FIGS. 30 and 31 illustrate various other types of buckles 3002, 3004, 3102, and 3104 that are known in the art, which can be used to secure opposing ends of like straps. The securing straps may be opposing ends of a belt 2600, which may be wrapped entirely around the decorative surround 100, as illustrated in FIGS. 26-29 or secured to opposing first and second ends 402, 404 of the array of slats 102, in a manner similar to how the magnets and magnetic strips are secured to and extend from the first and second ends 402, 404 of the array of slats 102 illustrated in connection with FIGS. 8-9.

Figure 32:
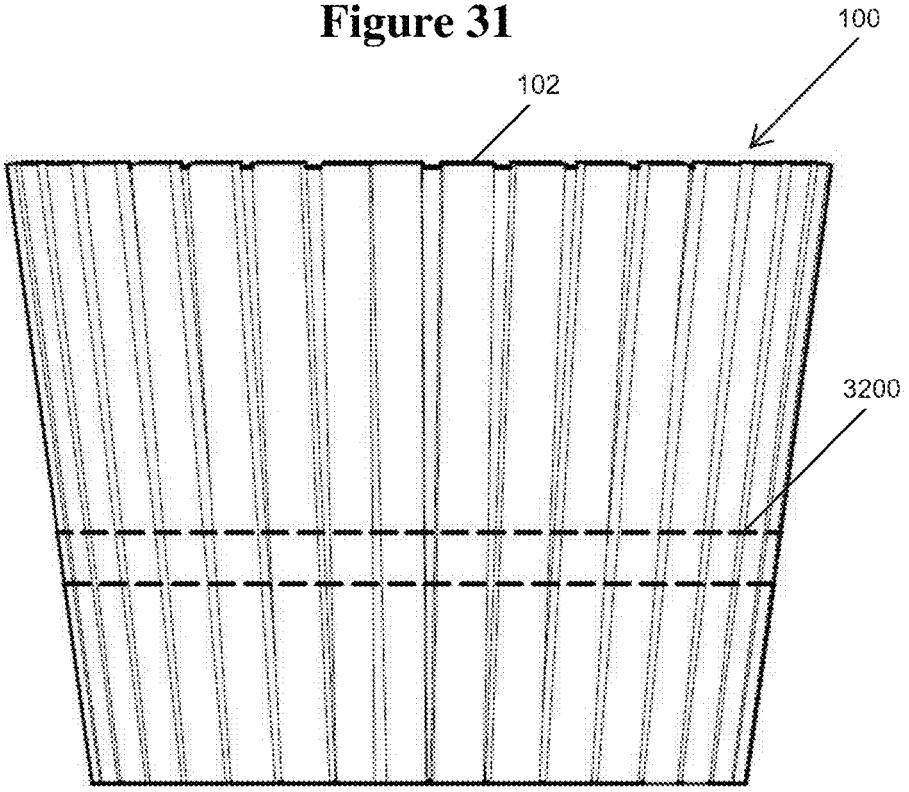
FIG. 32 illustrates the example of a placement of a securing mechanism of the present invention.
Figure 33:
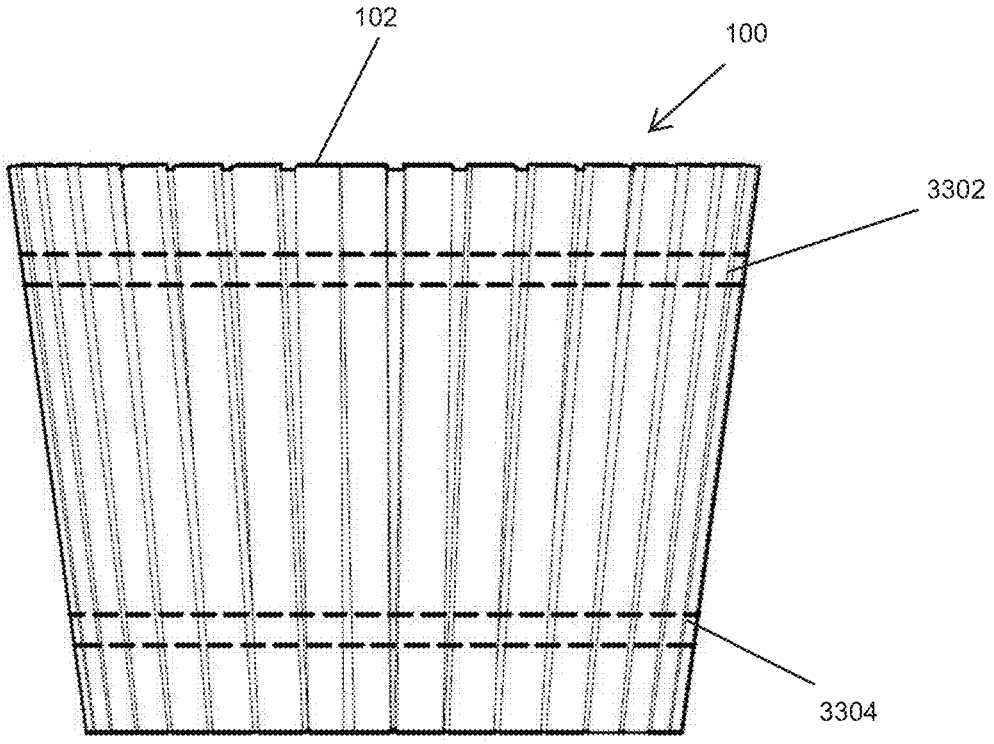
FIG. 33 illustrates another example of placement of securing mechanisms of the present invention.

FIGS. 32 and 33 illustrate various placements of securing mechanisms 420 along the array of slats 102 forming the decorative surround. For example, FIG. 32 illustrates the use of one securing mechanism 420 position on the lower half of the decorative surround 100. FIG. 33 illustrates another example of how securing mechanisms 420 can be placed on both the upper and lower halves of the decorative surround 100. Those skilled in the art will recognize that securing mechanisms 420 positioned around the decorative surround 100 can be placed in any position around the decorative surround 100 that holds the array of slats 102 around the object or container 400. Further, as illustrated above, it is not necessary to use a securing mechanism 420 that encircles the entire array of slats 102. A securing mechanism 420 can be used that affixes to only the opposing ends 402, 404. The type of securing mechanism 420 used may be selected, in part, based upon application or aesthetics.

As illustrated in connection with the FIGS. 34-37, the slats 102 may come in different shapes, cross-sections and include varying ornamental features to alter the overall look of the decorative surround 100.

Figure 34:
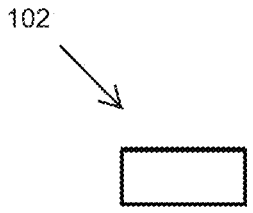
FIG. 34 illustrates a cross-section of one example of a slat that may be used in connection with the present invention.
Figure 35:
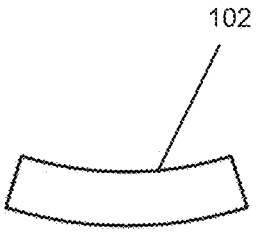
FIG. 35 illustrates another example of a cross-section of a slat that may be used in connection with the present invention.

FIGS. 34 and 35 illustrate horizontal cross-sections of different examples of slat 102 that may be used in connection with the present invention. As illustrated in FIG. 34, the cross-section may be generally rectangular. As illustrated in FIG. 35, the cross-section may include a curvature. Those skilled in the art will recognize that other shapes may be used for the slats and that the above are merely two illustrated examples.

Figure 36:
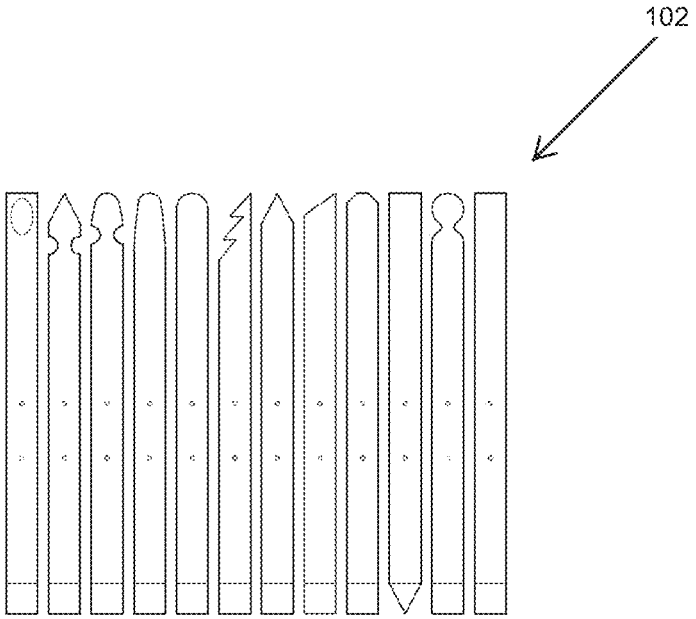
FIG. 36 illustrates further various examples of slat shapes that may be used in connection with the present invention.
Figure 37:
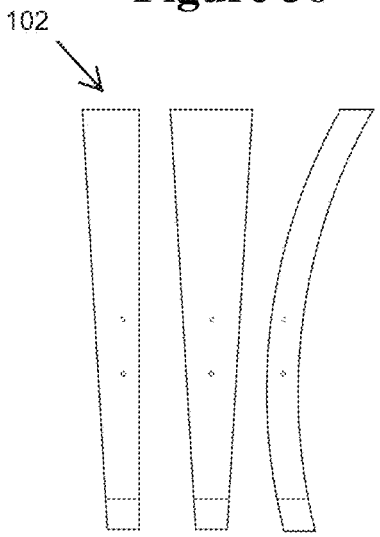
FIG. 37 illustrates further various examples of slat shapes that may be used in connection with the present invention.

FIGS. 36 and 37 illustrate further various examples of slat shapes that may be used in connection with the present invention. FIG. 37 illustrates how the tops and/or bottom of the slats 104 may include decorative features. Further, the bottoms of the slats 102 may include further functional features, such as a stake for placement of the array of the slats forming the decorative surround underneath the soil level, rather than forming a flat surface for sitting on the ground.

It will be understood that various aspects or details of the invention may be changed without departing from the scope of the invention. Furthermore, the foregoing description is for the purpose of illustration only, and not for the purpose of limitation.

As noted earlier, the array may come in a predetermined length for positioning around a container of a certain size. Alternatively, the size of the array may be modified to fit around smaller or larger containers by adding or removing slats 102 from the array.

Although the above description and illustrated drawings show the decorative surround being placed around a circular container, those skilled in the art will recognize that the decorative surround, due to its flexible nature, may be positioned around a container of virtually any size and shape, including but not limited to, square, rectangular, oval and odd or uniquely shaped containers.

Further, while numerous examples of fastening mechanisms 104 are provided above that create a hinged connection between the slats that allow both vertical and horizontal pivotally movement, the provided examples should not be limiting. Other possible means for securing the slats together via hinged connection are possible and are within the scope of this invention. By way of example, the slats may be coated and interconnected with a flexible coating, e.g., rubber coating, to create a hinged connection between the slats.

Those skilled in the art will recognize that other hinged connecting mechanisms may be used without departing from the scope of this invention. Such connecting mechanisms may include magnets or pins, which can further allow for ease of modification or adaptability in the modular construction to suit the required circumstances.

The foregoing description of the implementation of this device has been presented for purposes of illustration and description. It is not exhaustive and does not limit the claimed invention to the precise form disclosed. Modifications and variations are possible in light of the above description or may be acquired from practicing the invention. The claims and their equivalents define the scope of the invention.

I claim:

1. A decorative surround comprising:

an array of slats for surrounding a plant container having a first array end and second array end with each slat in the array of slats having a vertical length and horizontal width along front and rear faces of each slat and each slat in the array being separated by a gap;

where each slat in the array between the first and second array end are connected to one another by a connection located at a point below the vertical center of the array; and where the connection includes a hinged connection that allows for horizontal movement between slats in the array, allowing for the angle between the horizontal width of the slats to be adjusted, and a pin connection that includes a pivot pin positioned perpendicular to the horizontal width of the slats that allows for vertical movement between the slats in the array, allowing for the angle between the vertical length of the slats to be adjusted, such that, when the first array end and second array end of the array of slats are positioned adjacent to one another, an enclosure is formed by the array of slats, whereby the pin connection and hinged connection operate together to allow for the simultaneous horizontal and vertical movement between the array of slats.

2. The decorative surround of claim 1, where, when the first array end and second array end of the array of slats are positioned adjacent to one another, the slats are capable of angling relative to one another along the vertical axis to create a flared effect by closing the gap between the slats near the bottom of the enclosure formed by the array of slats and widening the gap between the slats near the top of the enclosure formed by the array of slats to surround a tapered container.

3. The decorative surround of claim 1 further comprises a securing mechanism for maintaining the first array end and second array end of the array of slats adjacent to one another.

4. A decorative surround comprising:

a plurality of fastening mechanisms;

a plurality of slats each having a vertical length and horizontal width, the plurality of slats each being connected to one another in a spaced-apart relationship by the plurality of fastening mechanisms, where at least one fastening mechanism in the plurality of fastening mechanisms is secured to each slat at a point below the center of the vertical length of the slats; and where the plurality of fastening mechanisms each include a hinged connection between the slats to allow for the relative angular movement of the slats toward one another along a horizontal axis and a pin connection to allow for the relative angular movement of the slats toward one another along a vertical axis, whereby the pin connection includes a pin that is releasable and when released causes the slats to separate in a removable manner to allow for additional slats to be added or for removal of existing slats.

5. A decorative surround comprising:

a plurality of individual fastening mechanisms;

a plurality of slats each having a vertical length and horizontal width and a front face, rear face and two opposing sides, the plurality of slats each having an individual fastening mechanism secured to the rear face of each slat at a point below the center of the vertical length of the slats;

where the plurality of individual fastening mechanisms are each connected to one another, in series, on the rear face of each slat, in a manner that creates a gap between the plurality of slats and a hinged connection between each two closest of the plurality of slats to create an array of slats that allows for the relative angular movement of the slats in the array toward one another in at least one direction along a horizontal plane;

where connection between the plurality of individual fastening mechanisms includes a pin that can be released to allow for additional slats to be added or for removal of existing slats.

6. A decorative surround comprising:

a plurality of slats connected together to form an array of slats for surrounding a plant container, the array of slats having a first array end and second array end;

a plurality of individual fastening mechanisms removably connected to each slat where the fastening mechanisms connect each slat between the first array end and second array end in a hinged manner and where the first array end and second array end include a securing mechanism for securing the first array end and second array end together to create an enclosure having a top and a bottom, where the plurality of individual fastening mechanisms are connected to each slat at a point below center such that when the first array end and second array end of the array of slats are positioned adjacent to one another, the slats are capable of angling relative to one another along the vertical axis to create a flared effect by allowing the slats at the bottom of the enclosure to be closer to one another than the slats at the top of the enclosure; and where each fastening mechanism in the plurality of individual fastening mechanisms includes a first hinge plate and a second hinge plate, where the first hinge plate of a first fastening mechanism connects to a first slat in the array of slats and the second hinge plate of the first fastening mechanism overlaps the first hinge plate of a second adjacent fastening mechanism, where the first hinge plate of the second adjacent fastening mechanism connects to a second slat in the array positioned adjacent to the first slat and where the second hinge plate of the first fastening mechanism is connected to the first hinge plate of the second fastening mechanism with a pivot pin such that all of the first hinge plates of the plurality of individual fastening mechanisms align to the same plane when the array of slats is in an open flat state.

7. The decorative surround of claim 6, where the first array end and second array end include magnets and the securing mechanism is a magnetic connection formed by the magnets on the first and second array ends.

8. The decorative surround of claim 6 where the securing mechanism is screw fastener.

9. A decorative surround comprising:

an array of slats for surrounding a plant container having a first array end and second array end with each slat in the array of slats having a vertical length and horizontal width along front and rear faces of the slats and each slat in the array being separated by a gap;

where each slat in the array between the first and second array ends is connected to another slat by a connection located at a point below the vertical center of the array; and where the connection includes a hinged connection that allows for horizontal movement between slats in the array, allowing for the angle between the horizontal width of the slats to be adjusted, and a pin connection that allows for vertical movement between the slats in the array, allowing for the angle between the vertical length of the slats to be adjusted, such that, when the first array end and second array end of the array of slats are positioned adjacent to one another, an enclosure is formed by the array of slats; and where the hinged connection and pin connection are formed by a first base plate affixed to a first slat in the array of slats and a second base plate affixed to a second slat in the array of slats and a first overlap plate connected, in a hinged manner, to the first base plate and affixed to the second base plate with a first pin, where the second base plate further includes a second overlap plate connected in a hinged manner to the second base plate, and where the first base plate includes a third overlap plate connected to the first base plate with a second pin;

and where the hinged connection and pin connection between the slats in the array of slats allow for the front and rear faces of each individual slat in the array of slats to align to the same plane when the array of slats is in an open flat state.

* * * * *